US005660496A

United States Patent [19]

Muller et al.

[11] Patent Number: 5,660,496

[45] Date of Patent: Aug. 26, 1997

[54] MODULAR CONSTRUCTION ROAD BARRIER SUITABLE TO GRADUALLY ABSORB THE IMPACT ENERGY OF VEHICLES

[75] Inventors: Franz Muller; Franco Gabbiani; Marco Anghileri, all of San Giuliano Milanese, Italy

[73] Assignee: Snoline S.p.A., San Giuliano, Italy

[21] Appl. No.: 503,729

[22] Filed: Jul. 18, 1995

[30] Foreign Application Priority Data

Apr. 19, 1995 [IT] Italy ..... MI95A0793

[51] Int. Cl.[6] ..... E01F 15/00

[52] U.S. Cl. ..... 404/6; 256/13.1

[58] Field of Search ..... 404/6, 9; 256/13.1; 293/107, 110; 188/377

[56] References Cited

U.S. PATENT DOCUMENTS

| | | | |
|---|---|---|---|
| 3,664,653 | 5/1972 | Walker | 293/107 X |
| 3,674,115 | 7/1972 | Young et al. | 404/6 X |
| 4,452,431 | 6/1984 | Stephens et al. | 404/6 X |
| 4,655,434 | 4/1987 | Bronstad | 256/13.1 |
| 4,674,911 | 6/1987 | Gertz | 404/6 |
| 5,391,016 | 2/1995 | Ivey et al. | 256/13.1 X |

FOREIGN PATENT DOCUMENTS

| | | | |
|---|---|---|---|
| 3900627 | 7/1990 | Germany | 404/6 |

*Primary Examiner*—James Lisehora
*Attorney, Agent, or Firm*—Bucknam and Archer

[57] ABSTRACT

A modular construction road barrier suitable to gradually absorb the impact energy of vehicles has flexible vessels for pneumatically absorbing the energy deriving from an impact, preferably in combination with a structure which absorbs friction controlled by the mutual sliding of the barrier elements. The friction absorbing structure can also be provided independently from the flexible vessels, thereby providing a gradually absorption of the vehicle impact energy. The barrier is moreover so constructed as to be easily located and recovered upon impact.

12 Claims, 3 Drawing Sheets

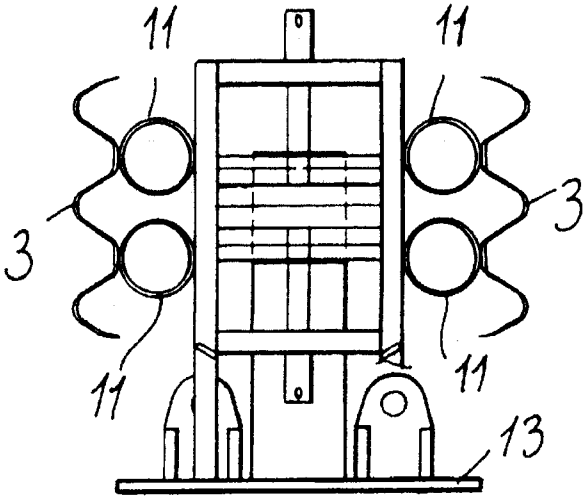
FIG. 5
FIG. 4
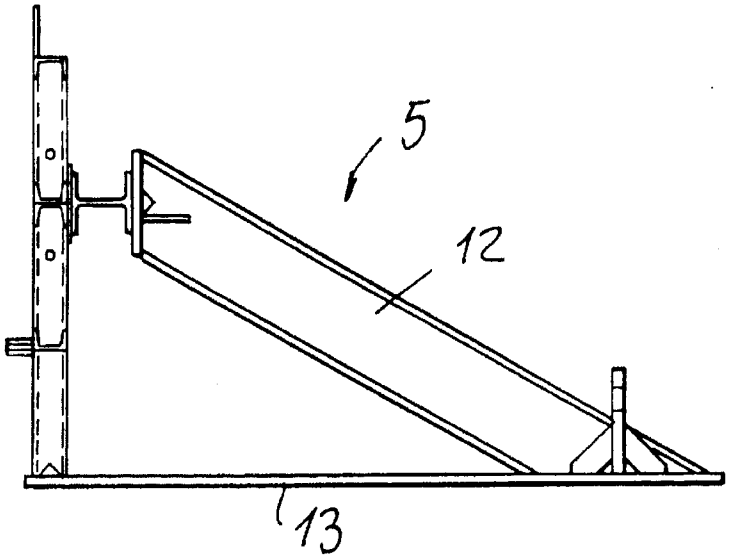
FIG. 6
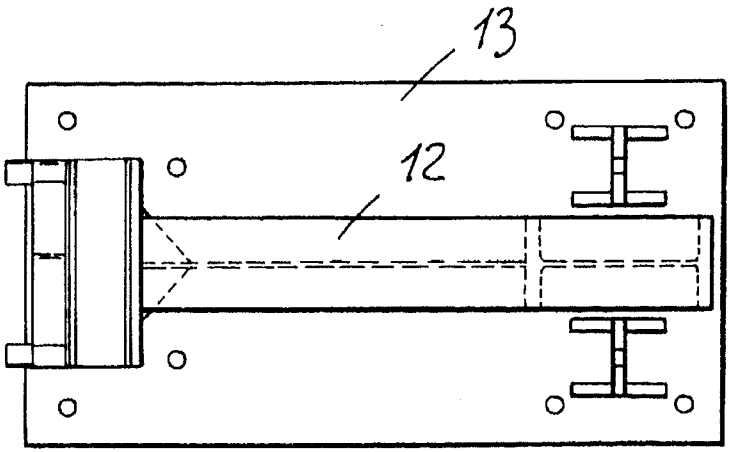

MODULAR CONSTRUCTION ROAD BARRIER SUITABLE TO GRADUALLY ABSORB THE IMPACT ENERGY OF VEHICLES

FIELD OF THE INVENTION

The present invention relates to a modular construction road barrier suitable to gradually absorb the impact energy of vehicles.

BACKGROUND OF THE INVENTION

As is known urban and extraurban roads usually comprise a lot of dangerous zones, where are arranged rigid obstacles, such as pillars, bridge shoulders, parapets, lighting poles and the like, steel and concrete safety barriers and other types of obstacles.

In order to prevent an impact against these obstacles from causing serious damages to the occupants of an impacting vehicle, in front of the mentioned obstacles, in order to protect the latter, there are conventionally provided impact absorbing systems, specifically designed for absorbing the vehicle impact energy so as to decrease the speed of the vehicle, thereby reducing noxious effects of an impact on the vehicle occupants.

Several impact damping devices are known, which are usually based on the momentum transfer principle, and which conventionally comprise damping materials, such as water or sand, or which operate by exploiting a plastic deformation of an inner construction, for example made of mineral, metal or plastic materials, such as, for example, rigid foamed plastic materials.

While these systems have been found to provide quite good protecting characteristics, they have the disadvantage that they can not be reused, or can be only partially reused: then, a recovering thereof would require a long time and a high cost.

Thus, it would be advantageous to provide, for the road barrier field, impact absorbing systems of simple construction and susceptible to an easy and quick maintenance at a low cost.

SUMMARY OF THE INVENTION

Accordingly, the object of the present invention is to provide a new type of road barrier, which can be constructed at a very low cost and which can be easily and quickly recovered upon an impact.

A main object of the present invention is to provide such a road barrier which is very safe in operation, and which, in particular, does not comprise any free pieces susceptible to be ejected from an impact zone thereof.

Another object of the present invention is to provide such a road barrier specifically designed for absorbing a great amount of impact energy both from heavy vehicles and from light vehicles.

According to one aspect of the present invention, the above mentioned objects, as well as yet other objects, which will become more apparent hereinafter, are achieved by a modular construction road barrier, suitable to gradually absorb a vehicle impact energy, characterized in that said road barrier comprises, either separately or in combination, pneumatic absorbing means and friction absorbing means, for absorbing the impact energy deriving from an impact.

BRIEF DESCRIPTION OF THE DRAWINGS

Further characteristics and advantages of the road barrier according to the present invention will become more apparent hereinafter from the following detailed disclosure of a preferred, though not exclusive, embodiment of the road barrier according to the invention, which is illustrated, by way of an indicative, but not limitative, example in the figures of the accompanying drawings, where:

FIG. 4 illustrates a rear support of the subject barrier, by a side elevation view;

FIG. 5 is a front view of the rear support; and

FIG. 6 is a top plan view of that same rear support.

DESCRIPTION OF THE PREFERRED EMBODIMENTS

Figure 1:
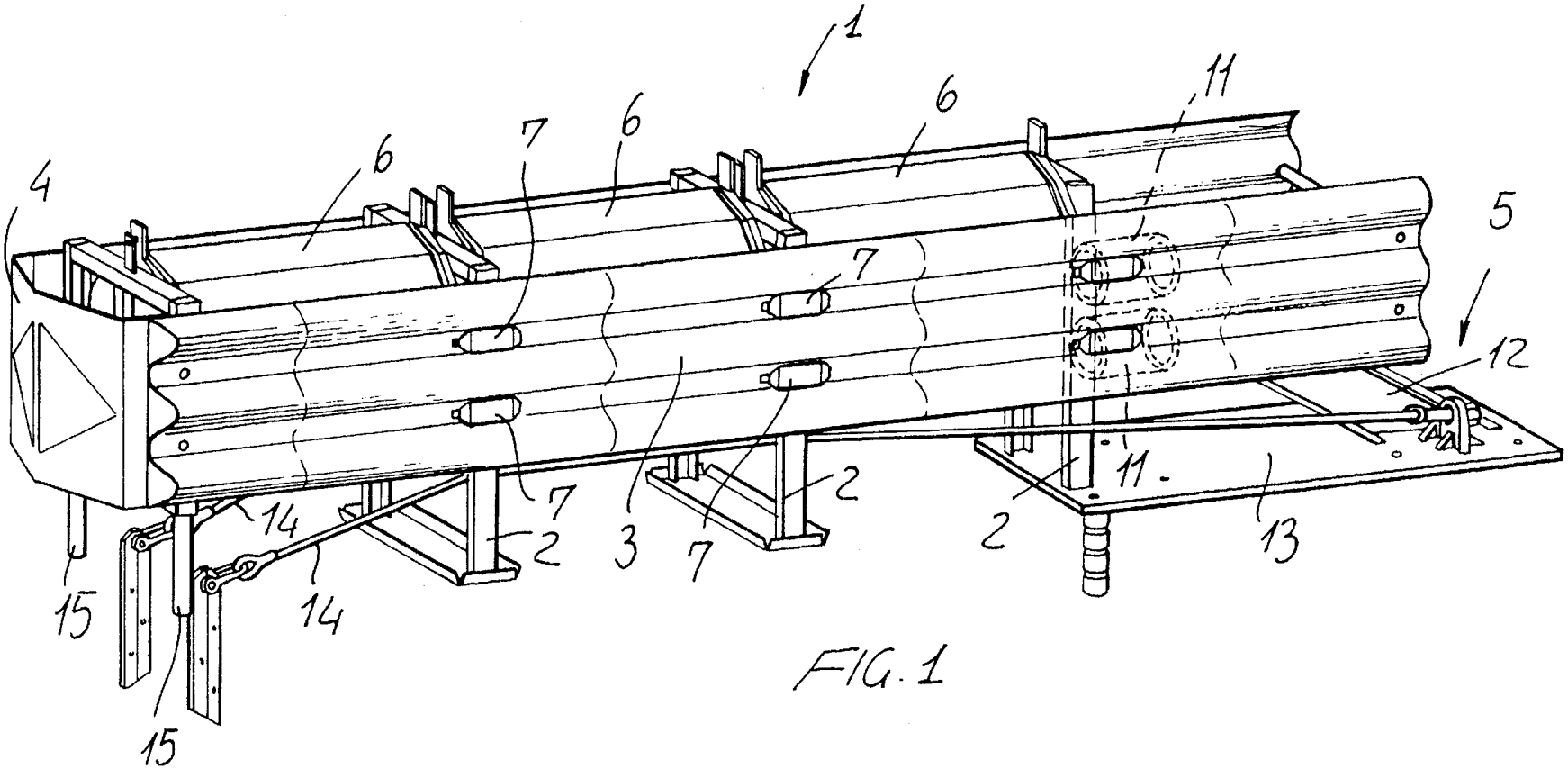
FIG. 1 is a perspective view illustrating the road barrier according to the present invention.

With reference to the number references of the aforesaid figures, the road barrier according to the invention, which has been generally indicated at the reference number 1, comprises a bearing construction, which is substantially constituted by uprights 2, provided with soil bearing feet, which are arranged at even distances along the extension of the barrier and which divide the barrier into a plurality of preferably like modules.

Moreover, the uprights 2 are connected to one another by side panels 3, preferably of a triple-wave blade type, of known construction, and which are coupled to the uprights 2, as it will be disclosed in a more detailed manner herein below.

The road barrier further comprises a front element 4 and a rear end-piece or support 5, which is anchored to the soil and constitutes a firm or static point of the system, constituted by the road barrier.

The road barrier according to the present invention comprises furthermore means for pneumatically absorbing the energy deriving from an impact.

More specifically, these pneumatic absorbing means substantially comprise flexible vessels 6, or bag elements, which in a rest condition thereof are extended and include in their inside atmospheric pressure.

These flexible vessels or bags 6 are sealed with respect to environment air and their connection to the outside environment is performed by means of a small hole provided on one of the two head portions thereof.

Each flexible vessel 2 is suitably made of a plasticized fabric shell having high pressure resistance characteristics, being for example suitable to resist against a pressure of 10–15 bars, and to atmospheric agents.

This shell extends between two head portions, which are so designed as to present air sealing properties, and which can be suitably made by molding a glass resinous material, as well as by assembling metal pieces.

The vessels 6 are provided, on the head portion thereof opposite to the head portion therethrough is formed the mentioned holes communicating the inside of the flexible vessels with the atmosphere, with a vent opening, which is closed by a tearable diaphragm which can be torn at a preset pressure, so as to allow the interior pressure of the vessels 6 to be monitored during the pressurizing step thereof.

Upon an impact, these vessels 6 will be compressed, so as to cause their inside air pressure to increase to a preset value.

As a pressure value corresponding to the tearing pressure value of the mentioned tearable diaphragm, and before achieving an end of stroke condition for the pressurizing of the vessel 6, the diaphragm will be torn, thereby allowing the pressurized air to be quickly ejected.

This will allow to achieve two advantageous results: at first, the vessel is prevented from operating as a spring, i.e. from returning the accumulated energy and causing the vehicle to backwardly bounce to a traffic lane. Moreover, by orienting the air vent opening in a direction opposite to the pressurizing direction, an out-flow effect will be obtained, with a dynamic pushing force opposite to the motion direction, which will contribute to reduce the speed of the vehicle.

From performed fluid-mechanics tests it has been found that, because of the small action times, in order to efficiently limit the pressure growth in the interior of the vessels 6, it is necessary to provide the vent opening with a large passage area, for example from 80 to 200 $cm^2$, which can not be provided by any washer valves of a size suitable for use in a system of the above disclosed type.

Figure 2:
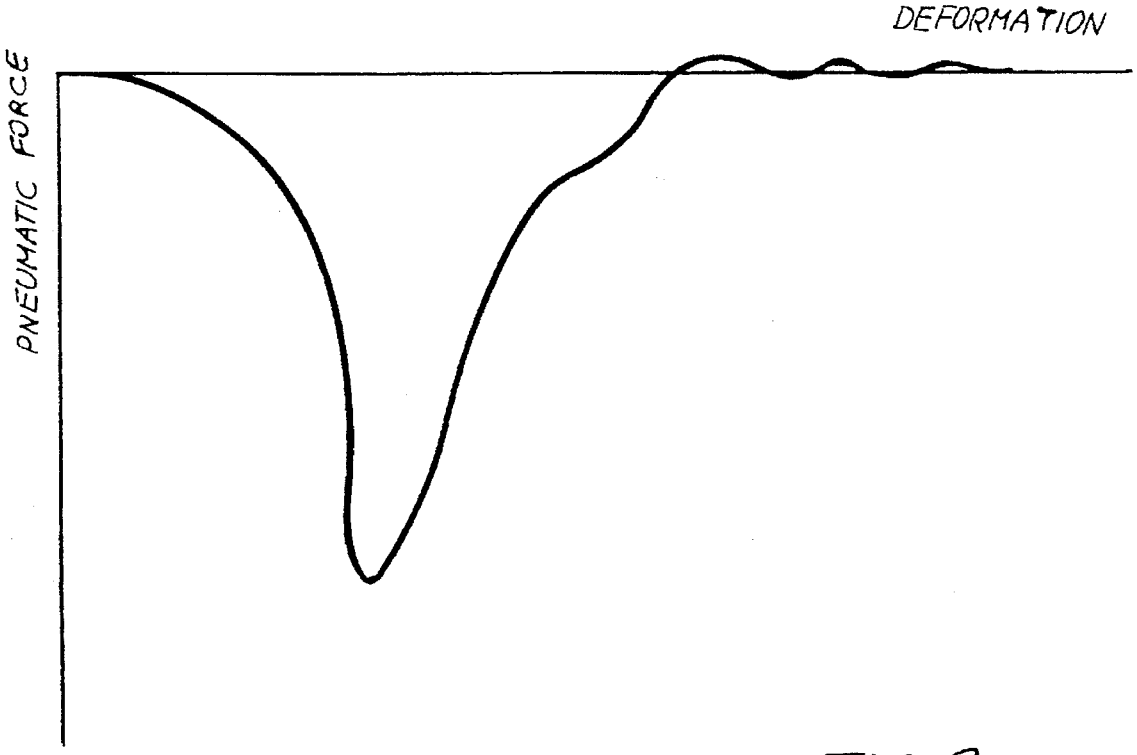
FIG. 2 illustrates a qualitative variation of the damping pneumatic force.

Thus, the inventive pneumatic system will provide very high reacting forces, which are gradually obtained by a squashing or deflecting type of method, according to an exponential law, as specifically shown in FIG. 2.

In this way, the safety characteristics will be greatly improved, since the lighter vehicles will exploit only a portion of the full stroke of the system and, accordingly, will be subjected to low forces with consequent low accelerations for the vehicle occupants, whereas the heavier vehicles will be subjected to greater forces and, accordingly, to a greater energy absorption, which will be obtained in the end portion of the pressing stroke.

A drawback of this system is that a great number of stages or modules must be provided, since the first portion of the compression, because of a nearly triangular evolution of the force, will absorb a comparatively poor amount of energy.

Figure 3:
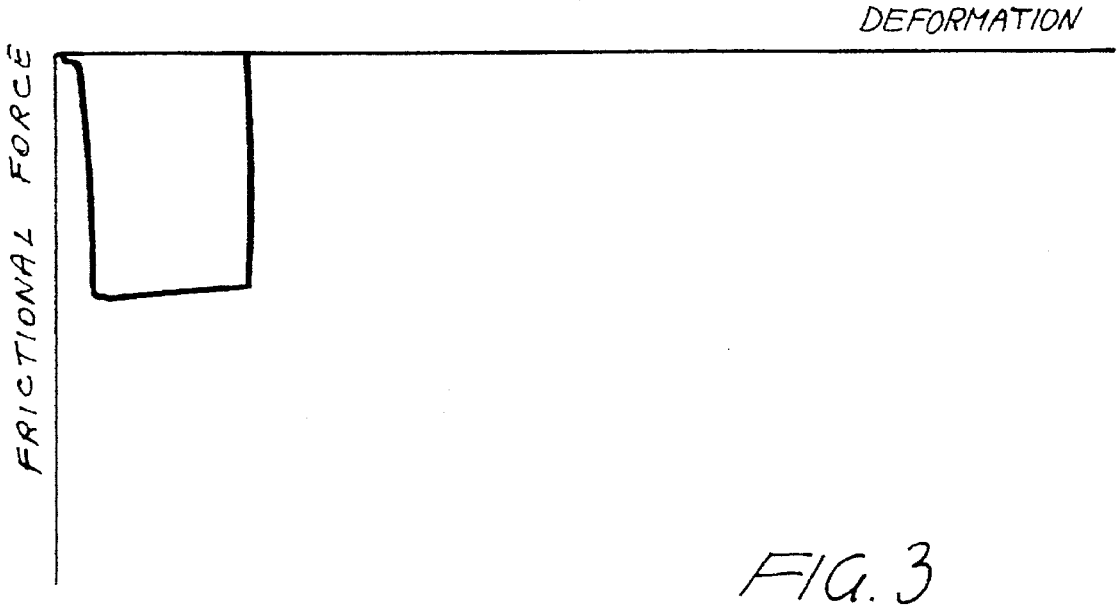
FIG. 3 illustrates a qualitative variation of the damping friction force.

Thus, it has been found that it would be advantageous to add to the pneumatic compression force a constant linear friction force: this force, suitably sized, will allow to remarkably increase the absorbed energy, while holding the accelerations for light weight vehicles at sufficiently low values, as shown in FIG. 3.

Actually, in a theoretical, though applicable, case, it would be possible to construct a barrier adapted to exclusively operate by friction absorbing means, without the pneumatic components or other components.

In this case, however, considering the acceleration limit set by the light weight vehicles, the length of the barrier would be excessively increased.

In the illustrated embodiment, the pneumatic absorbing means, as well as the friction absorbing means, are suitable to absorb a energy substantially equal to 20–70% of the total impact energy, preferably corresponding to 50% of the total impact energy.

This result has been obtained by two types of frictions: that caused by the feet, that is by the uprights 2, of the barrier against the road surface and that caused by the friction of the side panels 3 one against the other during their telescopic displacement due to the impact.

If the side panel 3, as in the illustrated embodiment, were constituted, for example, by guard-rail blades having a double or triple wave profile, provided with longitudinal slots for engaging therein sliders 7, then the friction could be generated and adjusted by operating on the slider 7 coupling force which connects the sliders with the blade elements constituting the side panels 3 and upright 2.

More specifically, this will correspond, for example, to a clamping of the slider connecting nuts adapted to provide a pressure force from substantially 80,000 to 160,000N. This can be easily achieved by a torque wrench or by using suitably calibrated resilient elements.

The sliders 7 which connect the side panels 3 to the uprights 2 of the several modules, in the particular case of a trapezoidal plan damping device of the type specifically shown in FIG. 1, must turn with respect to the uprights 2, so as to cause the side panels 3 to be superimposed onto one another during the telescopic motion generated by the impact, without tearing or outwardly pending.

Such an occurrence would constitute a danger for the oncoming vehicles.

The solution, which has been schematically represented as a hinge deriving from a yielding of the constraint, will be achieved by an extension of the pin connecting the slider 7 to the upright 2 and by an enlargement of the hole on that same upright, so as to provide the pin with an angular displacement capability for the desired extension.

The rear fixed point of the damping system, constituted by the subject barrier, is represented, as shown in particular in FIGS. 4 to 6—(and differently from other systems in which it is constituted by an independent reinforced concrete construction of long and expensive making)—by a rear end-piece or support 5, of a metal material, provided in single body with the barrier and specifically designed for improving the impact resistance in several different conditions.

More specifically, this rear support 5, provided with deformable side spacer elements 11, for example constituted by metal tubular elements, can controllably and softly react against side impacts, even at the proximity of the end piece.

These spacer elements 11 can also be advantageously constituted by great thickness steel lengths, having a thickness, for example, from 6 to 15 mm.

Moreover, the rear support will comprise one or more beams 12, slanted with respect to the bottom plate 13, preferably of a standardized type, for example of the type from IP 100 to IP 200, which will provide the additional advantage to turn by a plastic deformation, in the case in which the impact energy is much greater than the rated impact energy, thereby providing a further contribution to a controlled stopping of heavy vehicles.

The overall barrier will be conventionally affixed to the soil, by metal cables 14 operating to control the displacement of said barrier in the case of a front impact while allowing to substantially hold the shape thereof constant, and providing a comparatively small resilient deformation in the case of a side impact.

In particular, the cables 14 are advantageously provided in a number of at least two, both for safety requirements and for providing an increased side restraining force, beyond a set initial deformation of the barrier.

In the case of the side impact, in order to obtain from the vehicle a small-angle output trajectory, it is necessary to provide suitable initial adjusting characteristics for the cables 14.

More specifically, it has been found that the best results have been obtained with steel cables having a diameter from 18 to 34 mm, so pre-loaded to provide a clamping at the end portion, or by interposing resilient elements, of known characteristics, so as to generate a pulling force substantially from 70,000 to 140,000N.

Another feature of the barrier according to the present invention is that all the modules have a like construction and include like components, the starting one included, thereby providing an economic advantage and a greater efficiency, with respect to the energy absorption.

In order to prevent sticking effects from occurring during the sliding displacements or for overcoming possible interferences with the cables, the first supporting frame of the first module will be provided with plastic material legs 15, suitable to be easily broken upon impact.

The adjustments of the friction characteristics and of the air pressure could be different from module to module, for example be greater in the last modules, so as to provide a greater efficiency with respect to heavy vehicles.

From the above disclosure and from an observation of the figures of the accompanying drawings, the great safety and functionality characterizing the road barrier according to the present invention will be self-evident.

In particular, the fact should to be pointed out that a road barrier has been provided which is suitable to absorb a great amount of energy, in a gradual manner, so as to efficiently reduce the impact effects on the occupants of the impacting vehicle.

Obviously, the road barrier according to the present invention has been thereinabove disclosed and illustrated exclusively by way of a merely indicative, but not limitative, example, and merely in order to practically show the main characteristics of the invention, thereby it will be susceptible to several variations and modifications all of which will come within the scope of the invention.

In practicing the invention, the used materials, provided that they are compatible to the intended application, as well as the contingent size and shapes, can be any, depending on requirements.

We claim:

1. A modular construction road barrier, capable of gradually absorbing energy from an impacting vehicle, said road barrier comprising means for pneumatically absorbing said impact energy, said pneumatic absorbing means comprising flexible vessels, said vessels holding therein atmospheric pressure air under rest conditions, wherein said flexible vessels are provided with a vent opening and a tearable diaphragm for closing said opening, said diaphragm being torn at a set pressure, for controlling the pressure in the interior of said vessels during the compression thereof.

2. The road barrier, according to claim 1 wherein said vent opening has a size of 80–200 $cm^2$.

3. The road barrier, according to claim 1, wherein said pneumatic absorbing means absorb 20% to 70% of the total impact energy.

4. The road barrier according to claim 1 wherein said vent opening is directed in the direction of said impact so as to provide an outflow pushing force opposite to the motion direction.

5. The road barrier, according to claim 1, wherein said flexible vessels are bags.

6. A modular construction road barrier, capable of gradually absorbing the energy from an impacting vehicle, said road barrier comprising means for pneumatically absorbing said impact energy, wherein said barrier comprises a rear end-piece constituted by a metal construction including at least one beam slanted with respect to a horizontal plane, and wherein said rear end-piece is laterally provided with deformable spacer elements.

7. The road barrier, according to claim 6 wherein said spacer elements comprise metal pipes.

8. A modular construction road barrier, capable of gradually absorbing the energy from an impacting vehicle, said road barrier comprising a bearing construction, said bearing construction being constituted by uprights (2) and side panels (3), said uprights pressing against the road surface and dividing said barrier into a plurality of modules, said side panels (3) connecting said uprights to each other, said bearing construction further comprising a front structure (4) and a rear support (5), said uprights pressing against the road surface, said road barrier comprising means for absorbing said impact energy, said means being pneumatically absorbing means and friction absorbing means, said pneumatic absorbing means comprising flexible vessels holding therein atmospheric pressure air under rest conditions, wherein said flexible vessels are provided with head portions made of a resinous glass material and with a plasticized fabric shell having a compression resistance equal to at least 10 bar, wherein said friction absorbing means comprise side metal panels of said barrier, adapted to slide onto one another upon an impact wherein said barrier further comprises sliders for clamping said side panels with respect to one another, said sliders being clamped by a clamping moment suitable to generate on said sliders a force substantially from 80,000 to 160,000N and wherein said sliders are pivoted and swingably mounted about an axis on a related upright.

9. The road barrier, according to claim 8 wherein said pneumatic absorbing means during impact absorb 20% to 70% of the total impact energy.

10. The road barrier, according to claim 9 wherein said pneumatic absorbing means absorb substantially 50% of said total impact energy.

11. The road barrier, according to claim 8 wherein said friction absorbing means absorb substantially 20% to 70% of said total impact energy.

12. The road barrier, according to claim 11 wherein said friction absorbing means absorb substantially 50% of said total impact energy.

* * * * *